US012152813B2

(12) United States Patent
Kuppusamy et al.

(10) Patent No.: US 12,152,813 B2
(45) **Date of Patent: *Nov. 26, 2024**

(54) ADIABATIC COOLING SYSTEM WITH MIST CHAMBER

(71) Applicant: HEATCRAFT REFRIGERATION PRODUCTS LLC, Stone Mountain, GA (US)

(72) Inventors: Karthick Kuppusamy, Salem (IN); Sangameshwaran Sadhasivam, Kanchipuram (IN)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/478,849

(22) Filed: Sep. 29, 2023

(65) Prior Publication Data

US 2024/0027108 A1 Jan. 25, 2024

Related U.S. Application Data

(63) Continuation of application No. 17/733,318, filed on Apr. 29, 2022, now Pat. No. 11,808,491.

(51) Int. Cl.
*F25B 19/04* (2006.01)

(52) U.S. Cl.
CPC ..... *F25B 19/04* (2013.01)

(58) Field of Classification Search
CPC ..... F25B 19/04; F24F 1/0087; F24F 5/0035; F24F 1/0063; F24F 6/04; F24F 2006/046
USPC ..... 62/91; 92/305
See application file for complete search history.

(56) References Cited

U.S. PATENT DOCUMENTS 4,612,778 A * 9/1986 Medrano ..... F24F 6/04 62/304
8,950,205 B2 * 2/2015 Matracea ..... F25D 23/003 62/304
10,145,572 B2 * 12/2018 Dinnage ..... F24F 6/06

* cited by examiner

*Primary Examiner* — Steve S Tanenbaum

(57) ABSTRACT

An adiabatic cooling system includes a condenser coil and at least one mist chamber positioned around the condenser coil such that at least a portion of intake air for the adiabatic cooling system passes through the mist chamber prior to contacting the condenser coil. The at least one mist chamber includes a first cooling pad with a first intake-side face and a first output-side face and a second cooling pad with a first intake-side face and a first output-side face. The second-intake side face of the second cooling pad faces the first output-side face of the first cooling pad and is separated from the first-output side face of the first cooling pad by a gap. The gap includes a mist of water.

20 Claims, 5 Drawing Sheets

ADIABATIC COOLING SYSTEM WITH MIST CHAMBER

CROSS-REFERENCE TO RELATED APPLICATION

This application is a continuation of U.S. patent application Ser. No. 17/733,318 filed Apr. 29, 2022, now granted as U.S. Pat. No. 11,808,491, and entitled "ADIABATIC COOLING SYSTEMS WITH MIST CHAMBER", which is incorporated herein by reference.

TECHNICAL FIELD

This disclosure relates in general to adiabatic cooling systems, and more particularly to an adiabatic cooling system with a mist chamber.

BACKGROUND

Cooling systems are used in many types of residential and commercial applications. As one example, commercial refrigeration systems are used by many types of businesses such as supermarkets and warehouses.

SUMMARY

Cooling systems may use adiabatic cooling processes to pre-cool intake air that enters an outdoor condenser unit. For example, intake air may first pass through a wet pad or mesh material. Heat transfer with water on the material pre-cools the intake air. This disclosure recognizes drawbacks and disadvantages of conventional approaches to providing adiabatic cooling. For example, conventional pads used for adiabatic cooling may have a large pressure drop across the material, such that a large amount of energy is needed to drive the flow of air through the material. Moreover, a large amount of water may be required to sufficiently wet conventional cooling pads used in adiabatic cooling systems.

This disclosure provides a technical solution to problems of previous adiabatic cooling technology, including those recognized above, by providing a mist chamber that facilitates more efficient adiabatic cooling than was previously possible with a smaller pressure drop (i.e., and corresponding decreased energy consumption to drive the flow of air) and decreased water consumption. The mist chamber of this disclosure includes two cooling pads arranged face-to-face with a gap between the pads. The cooling pads are placed at the inlet(s) of a condenser, such that intake air received by the condenser passes through the cooling pads before reaching the condenser. One or more nozzles are located above, at, or near the top of the cooling pads. The nozzles are connected to a water source and provide a spray, or mist, of water droplets into the gap between the cooling pads. All or a portion of the mist may contact an internal face of the cooling pads and wet the cooling pads completely. In some embodiments, one or more of the nozzles may be positioned at an angle such that water is directed at least slightly towards the direction from which intake air is received to further improve performance of the mist chamber. Flow of water for providing the mist may be generated by an appropriate pump (e.g., a high-pressure pump). The water mist-containing environment created between the cooling pads facilitates mixing of intake air with the water in order to adiabatically cool the air (e.g., by reducing the dry bulb temperature of the air before it reaches the condenser).

The mist chamber operates at lower pressure drops than conventional materials used for adiabatic cooling and thereby reduces the consumption of power by a fan to provide a flow of air to the condenser. This improved efficiency is achieved during both wet mode and dry mode operation. The mist chamber of this disclosure also facilitates increased cooling, such that supply air can be more effectively cooled before it reaches the condenser, resulting in overall energy efficiency improvements of the cooling system. Furthermore, the mist chamber provides effective cooling with a decreased overall thickness of cooling pad material, such that material requirements and costs are decreased compared to previous approaches. Certain embodiments may include none, some, or all of the above technical advantages. One or more other technical advantages may be readily apparent to one skilled in the art from the figures, descriptions, and claims included herein.

In an embodiment, an adiabatic cooling system includes a condenser coil and at least one mist chamber positioned adjacent to the condenser coil such that at least a portion of intake air for the adiabatic cooling system passes through the mist chamber prior to contacting the condenser coil. The at least one mist chamber includes a first cooling pad with a first intake-side face and a first output-side face and a second cooling pad with a second intake-side face and a second output-side face. The second-intake side face of the second cooling pad faces the first output-side face of the first cooling pad and is separated from the first-output side face of the first cooling pad by a gap. At least one nozzle is configured, when the adiabatic system is operating in a wet mode, to provide a mist of water into the gap.

BRIEF DESCRIPTION OF THE DRAWINGS

For a more complete understanding of the present disclosure and its advantages, reference is now made to the following description, taken in conjunction with the accompanying drawings, in which.

DETAILED DESCRIPTION

Gas cooling systems are used in many types of residential and commercial applications. As one example, commercial refrigeration systems are used by many types of businesses such as supermarkets and warehouses. Many cooling systems use adiabatic cooling processes to pre-cool air before it enters an outdoor condenser unit. For example, large commercial refrigeration systems may include air cooled condensers where cooling pads are contacted with water in order to pre-cool intake air before it contacts condenser coils. While pre-cooling air using cooling pads aids in the overall efficiency of cooling systems in certain environmental conditions, cooling pads can be detrimental to the efficiency of the system if a large pressure develops across the pads such that an excessive amount of energy is needed to power fans driving airflow through the cooling pads. Existing pads also use a large volumes of water for adiabatic cooling.

To address these and other limitations of previous adiabatic cooling system technology, embodiments of this disclosure facilitate improved adiabatic cooling. The following describes adiabatic cooling systems with a new mist chamber that provides more efficient and more effective adiabatic cooling than was previously possible.

Figure 1:
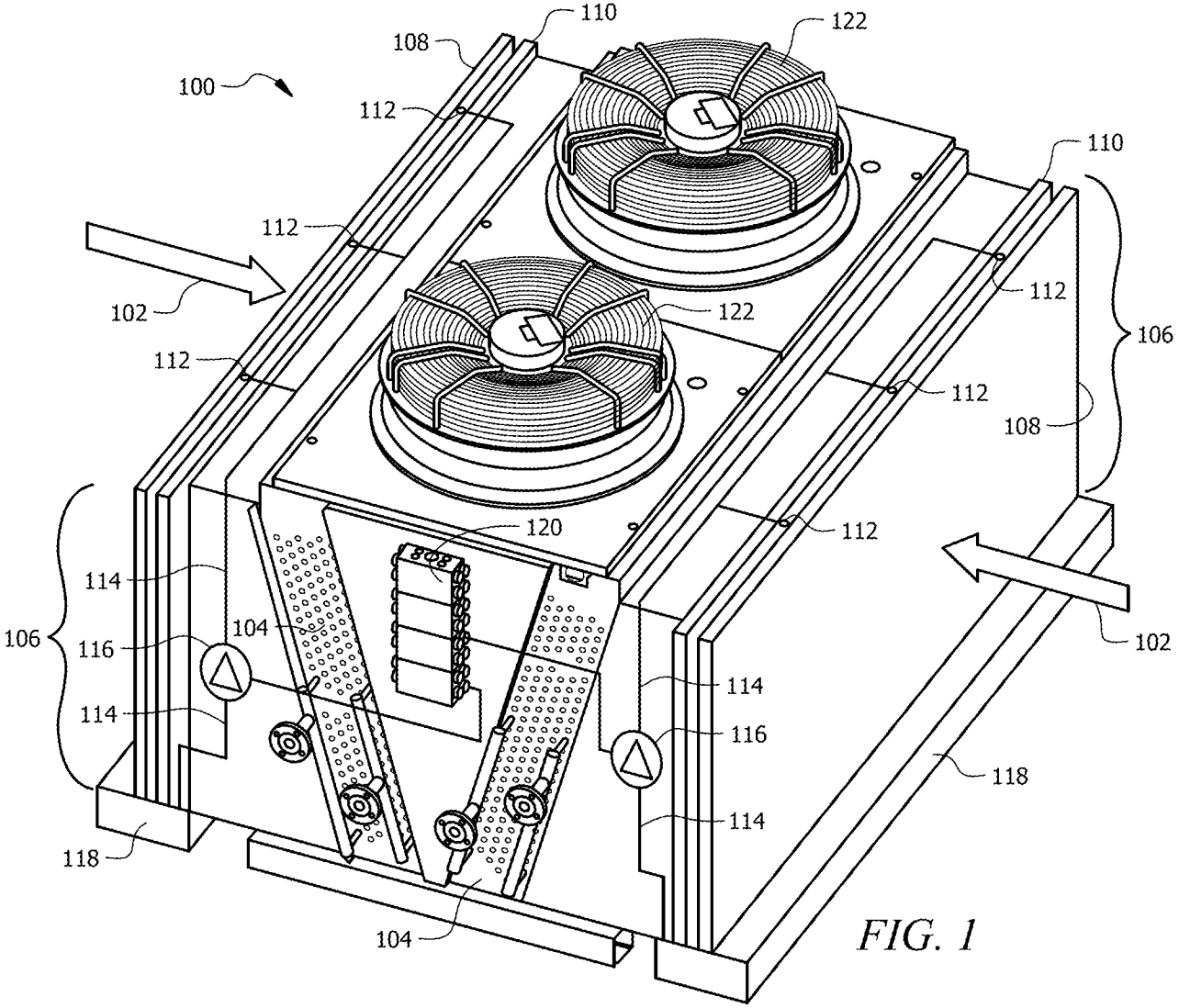
FIG. 1 is a diagram illustrating an example adiabatic cooling system with adiabatic mist chambers.
Figure 2:
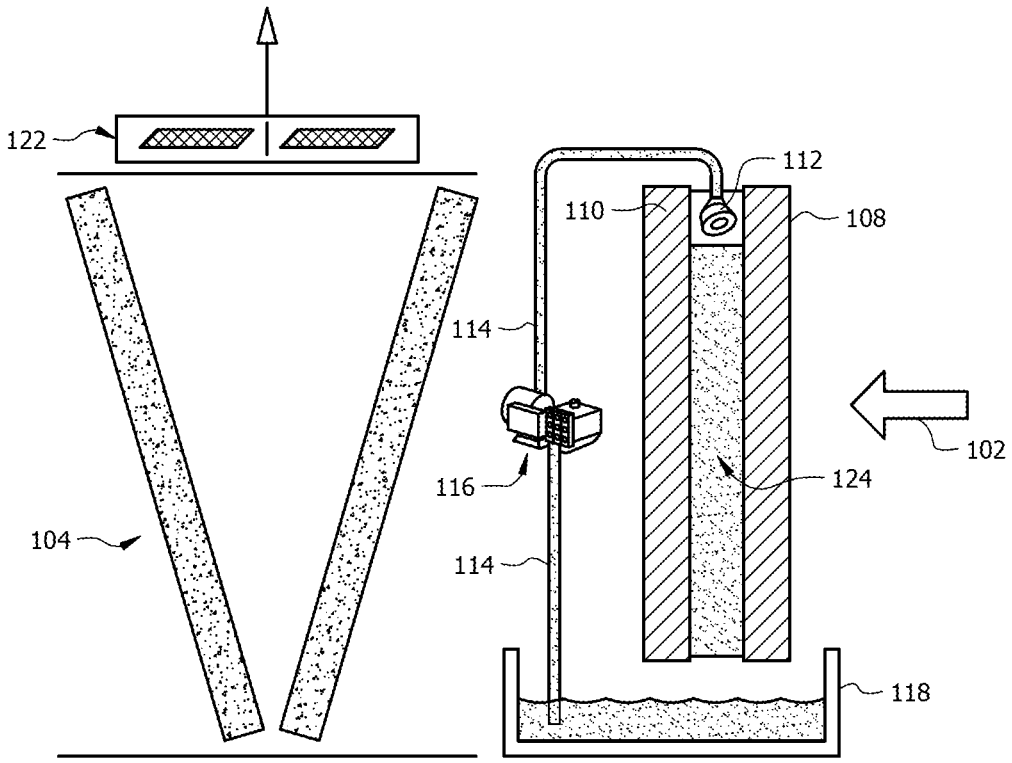
FIG. 2 is a diagram illustrating a portion of the system of FIG. 1 from a side view.

FIGS. 1 and 2 illustrate an example adiabatic cooling system 100 from different views. FIG. 1 shows the adiabatic cooling system 100 from an angled view, while FIG. 2 shows a subset of the components of the system 100 from a side view. The adiabatic cooling system 100 includes one or more condenser coils 104, one or more mist chambers 106, one or more pumps 116, one or more water sources 118, a controller 120, and one or more fans 122. Each mist chamber 106 includes face-to-face cooling pads 108 and 110 that are separated by a gap (e.g., a gap 142 illustrated in FIGS. 3A and 3B, described below). The mist chambers 106 are positioned adjacent to the condenser coils 104, such that at least a portion of intake air 102 that reaches the adiabatic cooling system 100 passes through the mist chambers 106 prior to contacting the condenser coils 104. One or more nozzles 112 are positioned to provide a water mist 124 (see FIG. 2) to the gap between the cooling pads 108, 110. For example, when adiabatic cooling is desired, the water mist 124 is provided within the gap or space between the cooling pads 108 and 110, as described further below.

Adiabatic cooling system 100 is a system used to cool a refrigerant by condensing it from its gaseous state to its liquid state in condenser coils 104. In certain refrigeration applications, adiabatic cooling system 100 is located outdoors and is fluidly coupled to indoor portions of the system (e.g., air handlers) via one or more refrigerant lines. In some embodiments, adiabatic cooling system 100 is a cooling tower. Adiabatic cooling system 100 includes one or more condenser coils 104 and one or more motors that turn one or more fans 122. The condenser coils 104 may be any type and configuration of heat exchange coil as appropriate for a given application (e.g., refrigeration, cooling a space, etc.). Fans 122 draw intake air 102 into adiabatic cooling system 100 through mist chambers 106, which, if the outdoor temperature is appropriately high (e.g., if outdoor temperature 508 is above threshold 510 of FIG. 5), are provided with a water mist 124.

The cooling pads 108, 110 may be held in place by pad frames or any other appropriate structure. The cooling pads 108, 110 may be made of any appropriate material that is capable of receiving and retaining water from the nozzles 112. As a few non-limiting example, cooling pads 108, 110 may be a mesh of a polymer, a cloth, a metal, and/or glass (e.g., a material formed of connected strands of one or more of these or similar materials) through which intake air 102 passes before it enters condenser coils 104. As intake air 102 passes through the wet cooling pads 108, 110 and the water mist 124 (see FIG. 2) between the cooling pads 108, 110, the intake air 102 is cooled. Cooling pads 108, 110 may be any appropriate size, shape, and configuration and are not limited to those illustrated in the included figures. While the examples of FIGS. 1-5 show a single pair of cooling pads 108, 110 on each inlet side of the adiabatic cooling system 100, the system 100 could include any appropriate number of cooling pads 108, 110.

The nozzles 112 are operable to provide water mist 124 to the space or gap between the cooling pads 108, 110 of the mist chamber 106. While the example of FIG. 1 shows three nozzles 112 for each mist chamber 106, this disclosure contemplates any number of nozzles 112 being positioned to provide the water mist 124. The nozzle(s) 112 are coupled to water source 118 via tubing 114. The water source 118 may be a container or tray holding water. The water source 118 may be connected to a municipal water supply or other supply of water (e.g., to refill or maintain a necessary volume of water in the water source 118).

A pump 116 may drive a flow of water from the water source 118 out of the nozzle(s) 112 and into the space between the cooling pads 108 and 110 as water mist 124. The pump 116 may be any appropriate pump for providing the flow of water at a sufficient pressure to generate the water mist 124. For example, the pump 116 may be a high-pressure fluid pump, such as a motor-driven pump that increases the pressure of water flowing through tubing 114. The example of FIG. 1 shows a separate pump 116 servicing each mist chamber 106, but a shared pump 116 could provide water flow for generating water mist 124 to both mist chambers 106 or additional pumps 116 could be present (e.g., to service separate nozzle(s) 112 in a given mist chamber 106 and/or provide backup water flow if another pump 116 should malfunction). In some embodiments, the water source 118 may be pressurized, and the pump 116 may be replaced with a valve that opens to allow the flow of pressurized water out of the nozzle(s) 112 as water mist 124.

The controller 120 may provide instructions (e.g., signal 514 of FIG. 5) for operating the pump 116. Further details of an example controller 120, its components, and its operation are provided below with respect to FIG. 5. For example, the controller 120 may cause the pump 116 to activate to provide the water mist 124 when the adiabatic cooling system 100 is to operate in a wet mode. Wet mode operation may be indicated when cooling is requested (e.g., to a space cooled using refrigerant cooled in the condenser coils 104) and the outdoor temperature is greater than a threshold value. As described below with respect to TABLE 1, the new mist chambers 106 of this disclosure provide improved adiabatic cooling with less pressure drop and lower water consumption during wet mode operation. If the outdoor temperature is relatively low (i.e., when it is relatively cool outside), the adiabatic cooling system 100 may be operated in a dry mode such that air is drawn through the condenser coils 106 but the water mist 124 is not provided. When the adiabatic cooling system 100 is operated in the dry mode, the dry mist chambers 106 have a decreased pressure drop compared to that of conventional cooling pads, such that efficiency is also improved during dry mode operation. For example, in some cases, the pressure drop across the mist chambers 106 may only increase by a few pascal (Pa) when switching from dry mode to wet mode operation. For example, the pressure drop may increase by less than 5 Pa when going from dry mode operation to wet mode operation. The pressure drop is the difference in air pressure on the inlet side and outlet side of the mist chamber 106.

Figure 3A:
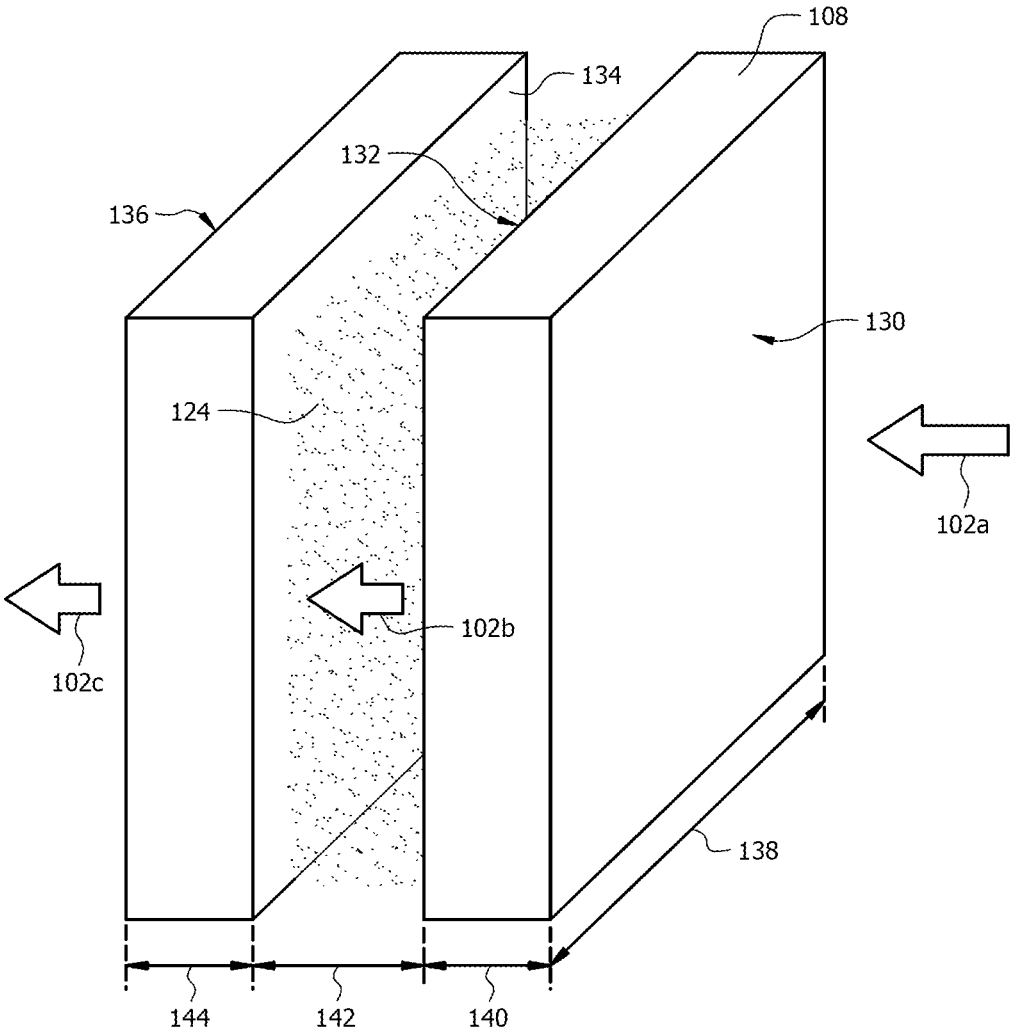
FIGS. 3A and 3B are diagrams illustrating the cooling pads of a mist chamber from two different perspective views.
Figure 3B:
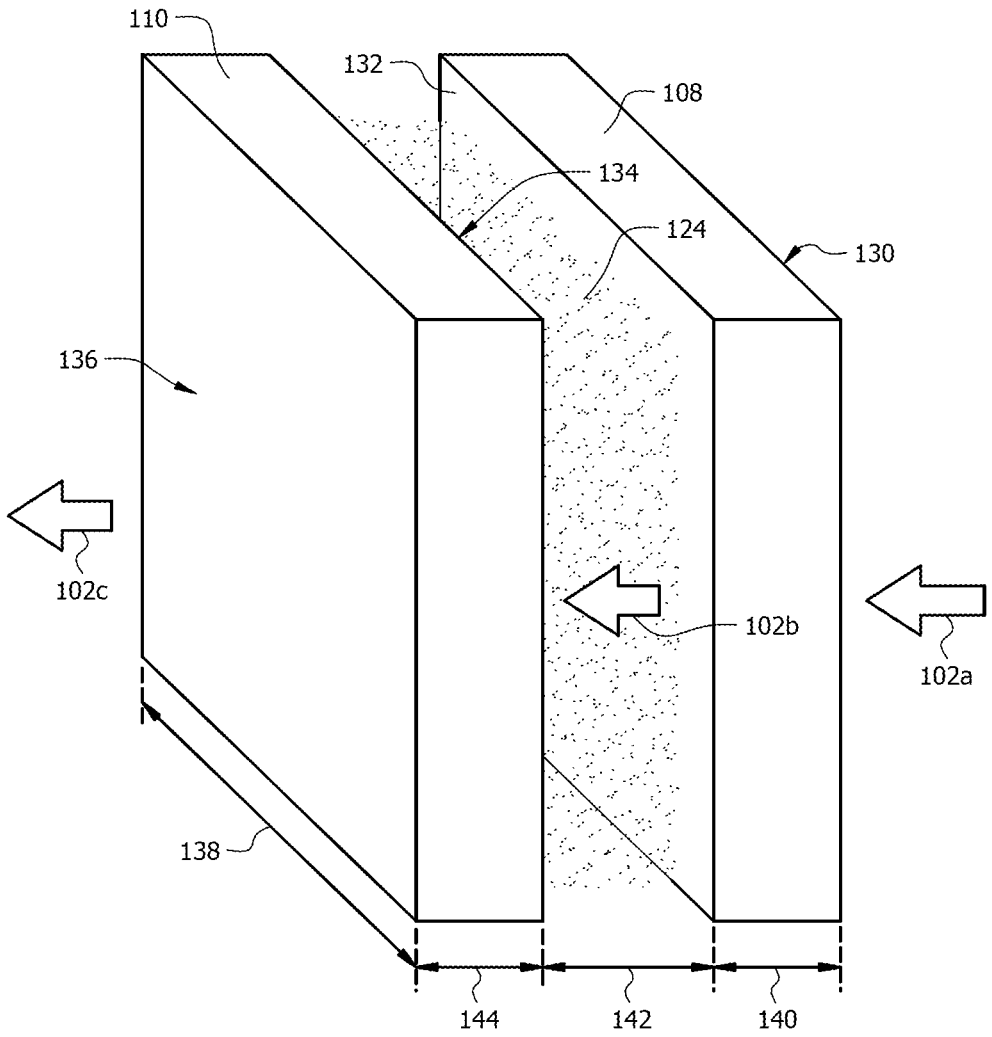

Turning to FIGS. 3A and 3B, an example arrangement of the cooling pads 108, 110 of the mist chamber 106 is shown from two different views. The cooling pads 108 and 110 are arranged in a face-to-face configuration such that intake air 102*a* passes through the first cooling pad 108 and contacts water mist 124 as air 102*b*. Air 102*b* is adiabatically cooled via contact with the water mist 124 (e.g., through humidification of the air 102*b*). This adiabatically cooled air 102*b* then passes through the second cooling pad 110 and proceeds to the condenser coils 104 (see FIGS. 1 and 2) as air 102*c*. Air 102*a* is also cooled via contact with water on or in (e.g., absorbed by) cooling pad 108, and air 102*b* is further cooled by water on or in cooling pad 110 to form cooled air 102*c*. Cooled air 102*c* may be at least 5 degrees Fahrenheit cooler than the intake air 102*a*.

The first cooling pad 108 has a corresponding intake-side face (or surface) 130 and an output-side face 132. The thickness 140 of cooling pad 108 may be any appropriate value for forming the mist chamber 106. In some embodiments, the thickness 140 may be in a range from about 50 millimeters (mm) to about 150 mm. In certain embodiments, the thickness is about 75 mm (e.g., in a range from 50 mm to 100 mm). The width 138 of the cooling pad 108 may be selected such that all or at least a significant portion (e.g., 80% or more) of intake air 102*a* passes through the cooling pad 108 in route to the condenser coils 104. For example, the width 138 of the cooling pad 108 may be the same or nearly the same (e.g., within about 10%) of the width of the condenser coils 104 of the adiabatic cooling system 100.

The second cooling pad 110 may be the same as or similar to the first cooling pad 108. The first and second cooling pads 108, 110 may be made of the same or different materials. The second cooling pad 110 includes a corresponding intake-side face 134 and an output-side face 136. The intake-side face 134 of the second cooling pad 110 faces (e.g., is located across from and parallel to) the output-side face 132 of the first cooling pad 108.

The first and second cooling pads 108 and 110 are separated from the first-output side face of the first cooling pad by a gap 142. The length of the gap 142 may be in a range from about 50 mm to 150 mm. In some embodiments, the gap 142 has a length of about 75 mm (e.g., in a range from about 50 mm to 100 mm). In some embodiments, the entire thickness (i.e., the sum of lengths 140, 142, and 144) is the same as or similar to the thickness of a conventional cooling pad. For example, the mist chamber 106 may be configured to be placed in a slot or frame that is designed to hold a conventional cooling pad. In such cases, the combined thickness of the cooling pads 108 and 110 (i.e., the combination of thicknesses 140 and 144) is less than that of a conventional cooling pad, resulting in decreased pressure drop across the cooling pads 108, 110. In some embodiments, the combined thickness of the cooling pads 108 and 110 (i.e., the combination of thicknesses 140 and 144) may be less than a threshold thickness value. For example, the combined thickness of the cooling pads 108 and 110 may be less than 100 mm, less than or equal to 75 mm, or the like. In some embodiments, the combined thickness of the cooling pads 108 and 110 is less than or equal to one half the thickness of a conventional cooling pad.

TABLE 1 below shows performance characteristics obtained from an adiabatic cooling system equipped with example mist chambers of this disclosure compared to those of the same system equipped with conventional cooling pads. The conventional pads were each 6 inch by 48 inch by 53 inch cellulose pad (i.e., with one pad on each air inlet side of the cooling system, see FIG. 1). The mist chambers included two face-to-face cellulose pads of 1.5 inch each (3 inches total for both cooling pads) by 48 inch by 53 inch with a 3-inch gap between the pads (see gap 142 of FIGS. 3A and 3B). Both setups were operated under adiabatic operation for 24% of the run time.

TABLE 1

Attributes of mist chamber compared to conventional cooling pad

| Attribute | Conventional Pad | Mist Chamber | Percent Improvement |
|---|---|---|---|
| Pad dimensions, w × l × h (inches) | 6 × 48 × 53 | Pads: 3 × 48 × 53 Gap: 3 inches | N/A |
| Adiabatic operation (%) | 24 | 24 | N/A |
| Saturation Efficiency (%) | 82 | 72 | N/A |
| Pressure drop-wet mode (Pa) | 70 | 43 | N/A |
| Pressure drop-dry mode (Pa) | 63 | 42 | N/A |
| Adiabatic COP | 23 | 32 | 38% |
| Water consumption (Gal) | 441862 | 389396 | 12% |

The saturation efficiency of the system with the conventional pad was slightly higher than that of the new mist chamber of this disclosure (82% vs 72%). However, the system with the new mist chambers had a much smaller in wet-mode pressure drop (43 Pa compared to 70 Pa for the conventional pads), corresponding to a significant savings in energy required to drive the flow of intake air (see air 102 of FIG. 1). When operated in the dry mode, the system with the new mist chambers also has a lower pressure drop (42 Pa) compared to that of the system with conventional pads (63 Pa). The change in pressure drop for the system with the new mist chambers between wet and dry mode operation is only 1 Pa.

The system with the new mist chambers also has a 12% increase in adiabatic coefficient of performance (COP), indicating that the mist chambers are more effective at providing adiabatic cooling that the conventional cooling pads. The adiabatic COP is calculated as the total operating capacity of the system divided by the sum of the compressor power, pump power, and the condenser fan power. The system with the mist chambers also consumed 12% less water than the system with the conventional pads. The mist chambers unexpectedly provided the combined improvements of decreased energy consumption (decreased pressure drop), increased cooling performance (increased adiabatic COP), and decreased water consumption, all of which facilitate more effective and sustainable adiabatic cooling operations.

Figure 4:
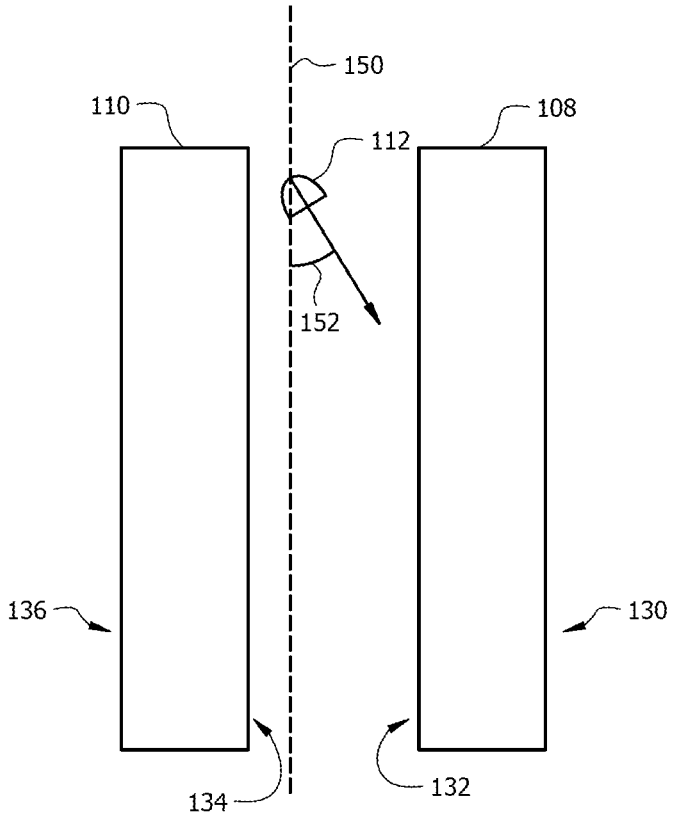
FIG. 4 is a diagram illustrating an example orientation of a misting nozzle in an example mist chamber.

In some embodiments, the nozzle(s) 112 may be positioned to further improve performance of the mist chambers 106. FIG. 4 illustrates a side-view of an example orientation of a nozzle 112 relative to the cooling pads 108, 110 to provide water mist 124. Direction 150 (dashed line) is parallel to the faces 134 and 132 of the face-to-face cooling pads 108 and 110. The nozzle 112 may be directed at an angle 152 toward the output-side face 132 of the first cooling pad 108. The angle may be in a range from about 20 degrees to 40 degrees relative to direction 150. In some embodiments, the angle 152 is about 35 degrees. Providing the water mist 124 at angle 152 may improve performance metrics, such as those described with respect to TABLE 1 above.

Figure 5:
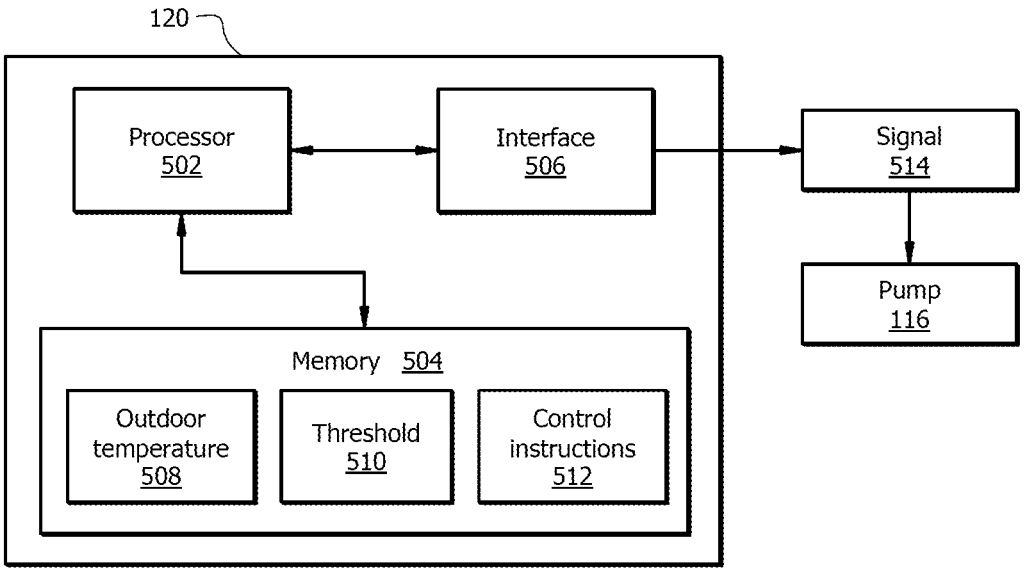
FIG. 5 is a diagram illustrating an example controller of the adiabatic cooling system of FIG. 1.

FIG. 5 illustrates an example controller 120 in greater detail. The controller 120 includes a processor 502, a memory 504, and an input/output (I/O) interface 506. The processor 502 includes one or more processors operably coupled to the memory 504. The processor 502 is any electronic circuitry including, but not limited to, state machines, one or more central processing unit (CPU) chips, logic units, cores (e.g. a multi-core processor), field-programmable gate array (FPGAs), application specific integrated circuits (ASICs), or digital signal processors (DSPs) that communicatively couples to memory 504 and controls the operation of the cooling system 100. The processor 502 may be a programmable logic device, a microcontroller, a microprocessor, or any suitable combination of the preceding. The processor 502 is communicatively coupled to and in signal communication with the memory 504. The one or more processors are configured to process data and may be implemented in hardware or software. For example, the processor 502 may be 8-bit, 16-bit, 32-bit, 64-bit or of any other suitable architecture. The processor 502 may include an arithmetic logic unit (ALU) for performing arithmetic and logic operations, processor registers that supply operands to the ALU and store the results of ALU operations, and a control unit that fetches instructions from memory 504 and executes them by directing the coordinated operations of the ALU, registers, and other components. The processor may include other hardware and software that operates to process information, control the cooling system 100, and perform any of the functions described herein (e.g., with respect to FIGS. 1-4). The processor 502 is not limited to a single processing device and may encompass multiple processing devices. Similarly, the controller 120 is not limited to a single controller but may encompass multiple controllers.

The memory 504 includes one or more disks, tape drives, or solid-state drives, and may be used as an over-flow data storage device, to store programs when such programs are selected for execution, and to store instructions and data that are read during program execution. The memory 504 may be volatile or non-volatile and may include ROM, RAM, ternary content-addressable memory (TCAM), dynamic random-access memory (DRAM), and static random-access memory (SRAM). The memory 504 is operable to store outdoor temperature 508, threshold(s) 510, and control instructions 512, which include any logic or instructions associated with performing the functions described in this disclosure. The outdoor temperature 508 is a temperature of an outdoor space in which the cooling system 100 is operated. For example, the outdoor temperature 508 may be measured by a temperature sensor positioned near the cooling system 100 or determined from weather data for the location of the cooling system 100. Threshold 510 may be a temperature threshold for operating in the wet mode. For example, when the outdoor temperature 508 exceeds the threshold 510, the control instructions 512 may be used to determine that the cooling system 100 should operate in the wet mode. The control instructions 512 cause the I/O interface 506 to send a signal 514 to the pump 116 to start operation in the wet mode (i.e., to turn on the pump 116 to provide the water mist 124 from the nozzle(s) 112 (see FIGS. 1-4 and corresponding description above).

The I/O interface 506 is configured to communicate data and signals with other devices. For example, the I/O interface 506 may be configured to communicate electrical signals with components of the adiabatic cooling system 100 including the signal 514 sent to control the pump 116, as described above. The I/O interface 506 may include ports or terminals for establishing signal communications between the controller 120 and other devices. The I/O interface 506 may be configured to enable wired and/or wireless communications.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. An adiabatic cooling system, comprising:

a condenser coil; and at least one mist chamber positioned in relation to at least one side of the condenser coil such that at least a portion of intake air for the adiabatic cooling system passes through the mist chamber prior to contacting the condenser coil, wherein the at least one mist chamber comprises:

a first cooling pad comprising a first intake-side face and a first output-side face; and a second cooling pad comprising a second intake-side face and a second output-side face, wherein the second intake-side face of the second cooling pad faces the first output-side face of the first cooling pad and is separated from the first output-side face of the first cooling pad by a gap, wherein the gap includes a mist of water.

2. The adiabatic cooling system of claim 1, further comprising:

at least one nozzle positioned to provide the mist of water;

a pump coupled to a water source and the at least one nozzle; and a controller communicatively coupled to the pump and configured to start the pump when an outdoor temperature is less than a threshold value.

3. The adiabatic cooling system of claim 1, wherein a length of the gap is in a range from about 50 millimeters to 100 millimeters.

4. The adiabatic cooling system of claim 1, wherein a combined thickness of the first cooling pad and the second cooling pad is less than 100 millimeters.

5. The adiabatic cooling system of claim 1, wherein a material of one or both of the first cooling pad and the second cooling pad is a mesh comprising one or more of a polymer, a cloth, a metal, and glass.

6. The adiabatic cooling system of claim 1, wherein, during operation of the adiabatic cooling system in a wet mode, the intake air is cooled by at least 5 degrees Fahrenheit.

7. The adiabatic cooling system of claim 1, further comprising at least one nozzle positioned to provide the mist of water, wherein the at least one nozzle is directed toward the first output-side face of the first cooling pad.

8. The adiabatic cooling system of claim 7, wherein the at least one nozzle is directed toward the first output-side face at an angle in a range from about 20 to 40 degrees relative to a direction parallel to the first output-side face.

9. The adiabatic cooling system of claim 1, wherein, during operation of the adiabatic cooling system in the wet mode, a wet-mode pressure drop across the first cooling pad, the gap, and the second cooling pad is less than 50 Pa.

10. The adiabatic cooling system of claim 9, wherein the wet-mode pressure drop across the first cooling pad, the gap, and the second cooling pad during operation of the adiabatic cooling system in the wet mode is less than 5 Pa greater than a dry-mode pressure drop the first cooling pad, the gap, and the second cooling pad during operation of the adiabatic cooling system in a dry mode, wherein during operation of the adiabatic cooling system in the dry mode the mist of water is not provided to the gap.

11. A mist chamber for an adiabatic cooling system, wherein the mist chamber is positioned in relation to at least one side of to a condenser coil such that at least a portion of intake air for the adiabatic cooling system passes through the mist chamber prior to contacting the condenser coil, the mist chamber comprising:

a first cooling pad comprising a first intake-side face and a first output-side face; and a second cooling pad comprising a second intake-side face and a second output-side face, wherein the second intake-side face of the second cooling pad faces the first output-side face of the first cooling pad and is separated from the first output-side face of the first cooling pad by a gap, wherein the gap includes a mist of water.

12. The mist chamber of claim 11, further comprising:

at least one nozzle positioned to provide the mist of water;

a pump coupled to a water source and the at least one nozzle; and a controller communicatively coupled to the pump and configured to start the pump when an outdoor temperature is less than a threshold value.

13. The mist chamber of claim 11, wherein a length of the gap is in a range from about 50 millimeters to 100 millimeters.

14. The mist chamber of claim 11, wherein a combined thickness of the first cooling pad and the second cooling pad is less than 100 millimeters.

15. The mist chamber of claim 11, wherein a material of one or both of the first cooling pad and the second cooling pad is a mesh comprising one or more of a polymer, a cloth, a metal, and glass.

16. The mist chamber of claim 11, wherein, during operation of the adiabatic cooling system in a wet mode, the intake air is cooled by at least 5 degrees Fahrenheit.

17. The mist chamber of claim 11, further comprising at least one nozzle positioned to provide the mist of water, wherein the at least one nozzle is directed toward the first output-side face of the first cooling pad.

18. The mist chamber of claim 17, wherein the at least one nozzle is directed toward the first output-side face at an angle in a range from about 20 to 40 degrees relative to a direction parallel to the first output-side face.

19. The mist chamber of claim 11, wherein, during operation of the adiabatic cooling system in the wet mode, a wet-mode pressure drop across the first cooling pad, the gap, and the second cooling pad is less than 50 Pa.

20. The mist chamber of claim 19, wherein the wet-mode pressure drop across the first cooling pad, the gap, and the second cooling pad during operation of the adiabatic cooling system in the wet mode is less than 5 Pa greater than a dry-mode pressure drop the first cooling pad, the gap, and the second cooling pad during operation of the adiabatic cooling system in a dry mode, wherein during operation of the adiabatic cooling system in the dry mode the mist of water is not provided to the gap.

* * * * *